US010316456B2

(12) United States Patent
Goshgarian et al.

(10) Patent No.: US 10,316,456 B2
(45) Date of Patent: Jun. 11, 2019

(54) METHODS AND APPARATUS TO DETECT TREATING CHEMISTRIES IN LAUNDRY APPLIANCES

(71) Applicant: WHIRLPOOL CORPORATION, Benton Harbor, MI (US)

(72) Inventors: David P. Goshgarian, Benton Harbor, MI (US); Karl David McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 9 days.

(21) Appl. No.: 15/420,455

(22) Filed: Jan. 31, 2017

(65) Prior Publication Data

US 2017/0137988 A1 May 18, 2017

Related U.S. Application Data

(62) Division of application No. 14/506,753, filed on Oct. 6, 2014, now Pat. No. 9,587,339.

(51) Int. Cl.

| | |
|---|---|
| ***D06F 39/02*** | (2006.01) |
| ***D06F 33/02*** | (2006.01) |
| ***D06F 37/22*** | (2006.01) |

(52) U.S. Cl.

CPC ..... *D06F 39/028* (2013.01); *D06F 33/02* (2013.01); *D06F 37/22* (2013.01); *D06F 39/02* (2013.01);

(Continued)

(58) Field of Classification Search

CPC ..... D06F 33/02; D06F 35/00; D06F 37/22; D06F 39/02; D06F 39/022; D06F 39/028;

(Continued)

(56) References Cited

U.S. PATENT DOCUMENTS

2004/0226961 A1* 11/2004 Mehus ..... B01F 1/0027 222/77
2010/0000022 A1* 1/2010 Hendrickson ..... D06F 39/02 8/137

(Continued)

FOREIGN PATENT DOCUMENTS

JP 08141273 A * 6/1996

OTHER PUBLICATIONS

Machine translation of JP-08141273-A to Morita, published Jun. 1996. (Year: 1996).*

*Primary Examiner* — Joseph L. Perrin
(74) *Attorney, Agent, or Firm* — Price Heneveld LLP

(57) ABSTRACT

An example laundry treating appliance includes a tub, a rotatable drum disposed in the tub and defining a treating chamber in which laundry is received for treatment according to a cycle of operation, a treating chemistry dispenser having an outlet and a cup having a siphon, configured to dispense a treating chemistry into at least one of the tub or the drum, a sensor, and a controller configured to at least: introduce a predetermined amount of liquid into the cup sufficient to activate the siphon if a predetermined amount of the treating chemistry is present in the cup; detect whether the siphon activates in response to the predetermined amount of liquid based on an output of the sensor; and modify cycle of operation based on whether the siphon activates in response to the predetermined amount of liquid.

9 Claims, 4 Drawing Sheets

(52) U.S. Cl.
CPC ..... *D06F 39/022* (2013.01); *D06F 2202/02* (2013.01); *D06F 2202/085* (2013.01); *D06F 2202/10* (2013.01); *D06F 2204/086* (2013.01)

(58) Field of Classification Search
CPC ..... D06F 2202/02; D06F 2202/085; D06F 2204/086
See application file for complete search history.

(56) References Cited

U.S. PATENT DOCUMENTS

| | | | | |
|---|---|---|---|---|
| 2010/0000024 | A1* | 1/2010 | Hendrickson | D06F 33/02 8/137 |
| 2010/0000578 | A1* | 1/2010 | Hendrickson | D06F 39/022 134/34 |
| 2012/0174632 | A1* | 7/2012 | Sung | D06F 39/022 68/17 R |
| 2016/0000297 | A1* | 1/2016 | Hodapp, Jr. | A47L 15/44 134/18 |

* cited by examiner

METHODS AND APPARATUS TO DETECT TREATING CHEMISTRIES IN LAUNDRY APPLIANCES

CROSS-REFERENCE TO RELATED APPLICATIONS

The present application represents a divisional application of and claims priority to U.S. patent application Ser. No. 14/506,753 (now U.S. Pat. No. 9,587,339), entitled "METHODS AND APPARATUS TO DETECT TREATING CHEMISTRIES IN LAUNDRY APPLIANCES" filed Oct. 6, 2014, currently allowed.

FIELD OF THE DISCLOSURE

This disclosure relates generally to laundry appliances, and, more particularly, to methods and apparatus to detect treating chemistries in laundry appliances.

BACKGROUND

Many conventional laundry treating appliances, such as a clothes washer, a clothes dryer, a clothes refresher, a non-aqueous clothes system, a dishwasher, etc. have dispensers for dispensing treating chemistry(-ies) into a chamber in which items are placed for treatment.

SUMMARY

A disclosed example laundry treating appliance includes a tub, a rotatable drum disposed in the tub and defining a treating chamber in which laundry is received for treatment according to a cycle of operation, a treating chemistry dispenser having an outlet and a cup having a siphon, configured to dispense a treating chemistry into at least one of the tub or the drum, a sensor, and a controller configured to at least: introduce a predetermined amount of liquid into the cup sufficient to activate the siphon if a predetermined amount of the treating chemistry is present in the cup; detect whether the siphon activates in response to the predetermined amount of liquid based on an output of the sensor; and modify cycle of operation based on whether the siphon activates in response to the predetermined amount of liquid.

A disclosed example method of operating a laundry treating appliance having a tub, a rotatable drum disposed in the tub and defining a treating chamber in which laundry is received for treatment according to a cycle of operation, and a treating chemistry dispenser to dispense a treating chemistry into at least one of the tub or the drum, includes adding a predetermined amount of liquid to a cup of the dispenser sufficient to activate a siphon in the cup if a predetermined amount of the treating chemistry is present in the cup, detecting whether the siphon activates in response to the predetermined amount of liquid, and modifying the cycle of operation based on whether the siphon activates in response to the predetermined amount of liquid.

DETAILED DESCRIPTION

Figure 1:
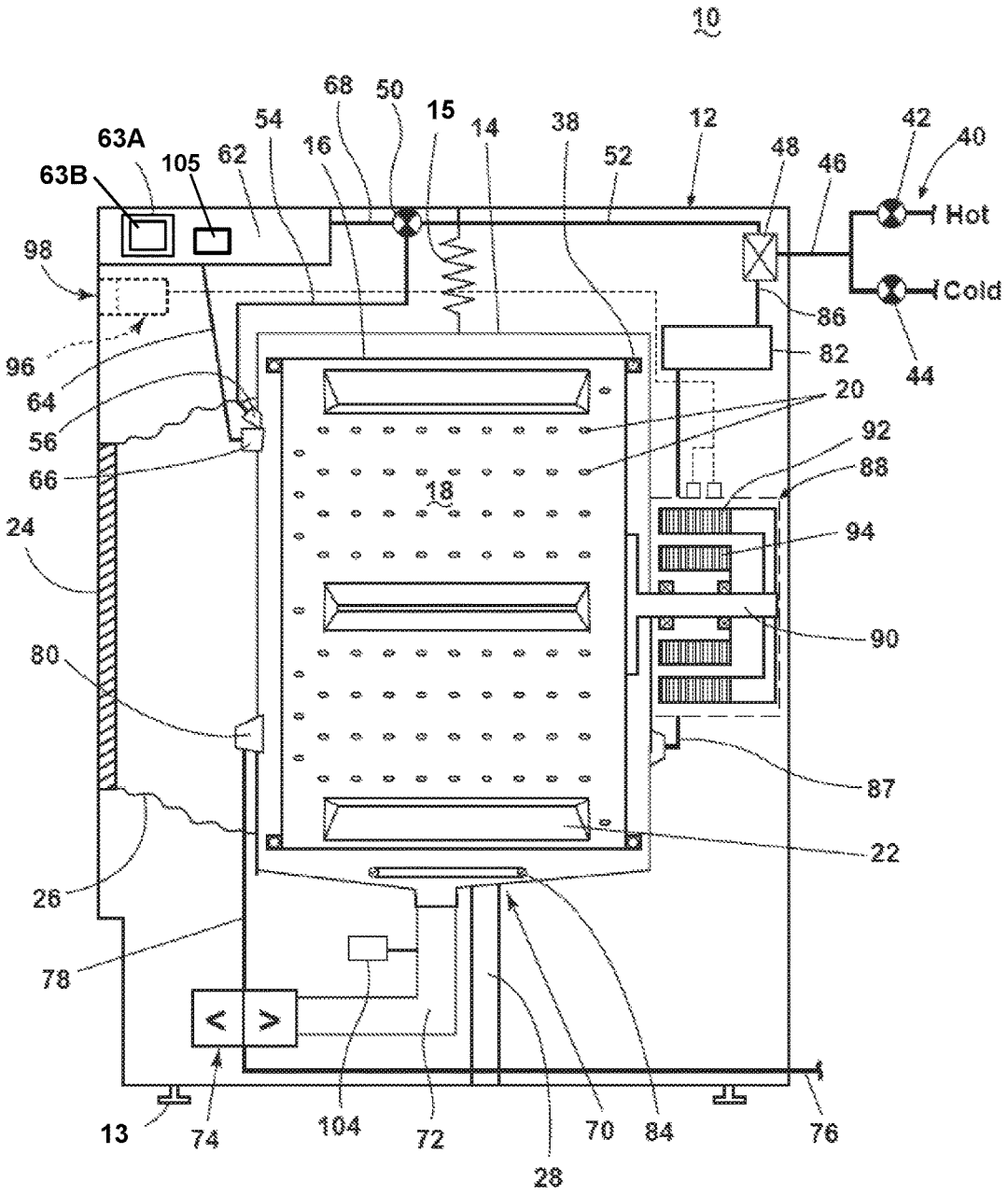
FIG. 1 is a schematic view of an example laundry treating appliance implementing treating chemistry detection in accordance with the teachings of this disclosure.

In conventional laundry treating appliances, detection of treating chemistry(-ies) is not performed. For such appliances, users have to indicate via a user interface what treating chemistry(-ies) have been placed in a dispenser. Accordingly, if they forget to indicate that, for example, bleach has been placed in a cup of the dispenser, they will find after a treating cycle of operation that the bleach remains in the dispenser cup. Such circumstances may result in frustration and decreased customer satisfaction. Alternatively, a laundry treating appliance may always assume that bleach is present, which will for some loads of laundry and cycles of operation unnecessarily increase cycle time and energy consumption, again resulting in decreased customer satisfaction. To overcome at least these problems, the examples disclosed herein detect the presence and absence of treating chemistry(-ies), and automatically adjust their cycles of operation. For example, if bleach is detected, bleach treatment can be automatically performed without a user needing to select bleach on a user interface. Accordingly, the user's intention of performing bleach treatment is automatically performed without the user having to perform the now unnecessary step of indicating bleach via the user interface. Because the user's intentions are automatically realized, customer satisfaction is increased. Moreover, by eliminating now unnecessary user interface elements (e.g., buttons and indicators), costs can be reduced and appliance aesthetics improved. It should be understood that any number and/or type(s) of modifications to a cycle of operation may be made in response to the detection of treating chemistry(-ies). For example, the portion of a cycle in which fabric softener is applied may be skipped, rinse cycles may be adjusted and/or skipped, etc. Moreover, the presence or absence of more than one treating chemistry may be detected and used to adjust a cycle of operation. Further still, an amount of detecting treating chemistry(-ies) may be used to adjust a cycle of operation.

Reference will now be made in detail to embodiments of this disclosure, examples of which are illustrated in the accompanying drawings. The embodiments are described below by referring to the drawings, wherein like reference numerals refer to like elements. Here, configurations of an example laundry treating appliance according to this disclosure will be described with reference to FIGS. 1 and 2. While the examples disclosed herein are described and illustrated with reference to a horizontal axis washing machine, those of ordinary skill in the art will recognize that the examples disclosed herein may be implemented in any other laundry treating appliance configuration.

FIG. 1 is a schematic view of an example laundry treating appliance. The laundry treating appliance may be any appliance that performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a horizontal-axis washing machine 10, which may include a structural support system comprising a cabinet 12 that defines a housing within which a laundry treating system resides. The cabinet 12 is a housing having a chassis and/or a frame defining an interior that encloses components typically found in a conventional washing machine, such as motors, pumps, fluid lines, controls, sensors, transducers, and the like. The washing machine 10 has one or more pairs of feet 13 extending from the cabinet 12 and supporting the cabinet 12 on a surface.

The example laundry treating system of FIG. 1 comprises a tub 14 supported within the cabinet 12 by a suitable suspension system 15, and a drum 16 provided within the tub 14, the drum 16 defining at least a portion of a laundry treating chamber 18. The drum 16 includes a plurality of perforations 20 such that liquid may flow between the tub 14 and the drum 16 through the perforations 20. A plurality of baffles 22 is disposed on an inner surface of the drum 16 to lift the laundry load received in the treating chamber 18 while the drum 16 rotates. It is also within the scope of this disclosure for the laundry treating system to comprise only a tub with the tub defining the laundry treating chamber.

The example laundry treating system further includes a door 24 that is movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 further includes the suspension system 15 for dynamically suspending the laundry treating system within the structural support system.

The washing machine 10 may also include at least one ball balancing ring 38 containing a balancing material moveable within the ball balancing ring 38 to counterbalance an imbalance that may be caused by laundry in the treating chamber 18 during rotation of the drum 16. The balancing material may be in the form of metal balls, fluid or a combination thereof. For example, the ball balancing ring 38 may comprises a plurality of metal balls suspended in a substantially viscous fluid. The ball balancing ring 38 extends circumferentially around a periphery of the drum 16 and may be located at any desired location along an axis of rotation of the drum 16. When multiple ball balancing rings 38 are present, they may be equally spaced along the axis of rotation of the drum 16.

The washing machine 10 further includes a liquid supply system for supplying water to the washing machine 10 for use in treating laundry during a cycle of operation. The liquid supply system includes a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48, which may direct the flow of liquid to a supply conduit 52. The second diverter mechanism 50 on the supply conduit 52 may direct the flow of liquid to a tub outlet conduit 54, which may be provided with a spray nozzle 56 configured to spray the flow of liquid into the tub 14. In this manner, water from the household water supply 40 may be supplied directly to the tub 14.

The example washing machine 10 is provided with a dispensing system for dispensing treating chemistry(-ies) to the treating chamber 18 for use in treating the laundry according to a cycle of operation. The dispensing system includes a dispenser 62, which may be a single use dispenser, a bulk dispenser, or a combination of a single and bulk dispenser. In general, the dispenser 62 includes cups or compartments (one of which is designated at reference number 63A) into which treating chemistry(-ies) are placed. One or more of the cups 63A contain a siphon 63B that flows or transfers liquid from its respective cup 63A into the treating chamber 18. Operation(s) of the cups 63A and siphons 63B are well known. Non-limiting examples of suitable dispensers are disclosed in U.S. Pat. No. 8,196,441 to Hendrickson et al., filed Jul. 1, 2008, entitled "Household Cleaning Appliance with a Dispensing System Operable Between a Single Use Dispensing System and a Bulk Dispensing System," U.S. Pat. No. 8,388,695 to Hendrickson et al., filed Jul. 1, 2008, entitled "Apparatus and Method for Controlling Laundering Cycle by Sensing Wash Aid Concentration," U.S. Pat. No. 8,397,328 to Hendrickson et al., filed Jul. 1, 2008, entitled "Apparatus and Method for Controlling Concentration of Wash Aid in Wash Liquid," U.S. Pub. No. 2010/0000581 to Doyle et al., filed Jul. 1, 2008, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pat. No. 8,397,544 to Hendrickson, filed Jun. 23, 2009, entitled "Household Cleaning Appliance with a Single Water Flow Path for Both Non-Bulk and Bulk Dispensing," and U.S. Pat. No. 8,438,881, filed Apr. 25, 2011, entitled "Method and Apparatus for Dispensing Treating Chemistry in a Laundry Treating Appliance," all of which are incorporated herein by reference in their entirety.

The example dispenser 62 may be configured to dispense treating chemistry(-ies) directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, detergent, enzymes, fragrances, stiffness/sizing agents, wrinkle releasers/reducers, softeners, bleach, non-chlorine bleach, antistatic or electrostatic agents, stain repellants, water repellants, energy reduction/extraction aids, antibacterial agents, medicinal agents, vitamins, moisturizers, shrinkage inhibitors, surfactants, color fidelity agents, and combinations thereof.

The washing machine 10 may also include a recirculation and drain system for recirculating liquid within the laundry treating system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system that may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 14 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system includes a controller 96 located within the cabinet 12, and a user interface 98 that is operably coupled with the controller 96. The user interface 98 may include one or more knobs, dials, switches, displays, capacitive touch areas, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to this disclosure. It is contemplated that the controller is a microprocessor-based controller that implements control software and sends/receives one or more electrical signals to/from each of the various working components to affect the control software. As an example, proportional control (P), proportional integral control (PI), and proportional derivative control (PD), or a combination thereof, a proportional integral derivative control (PID control), may be used to control the various components.

Figure 2:
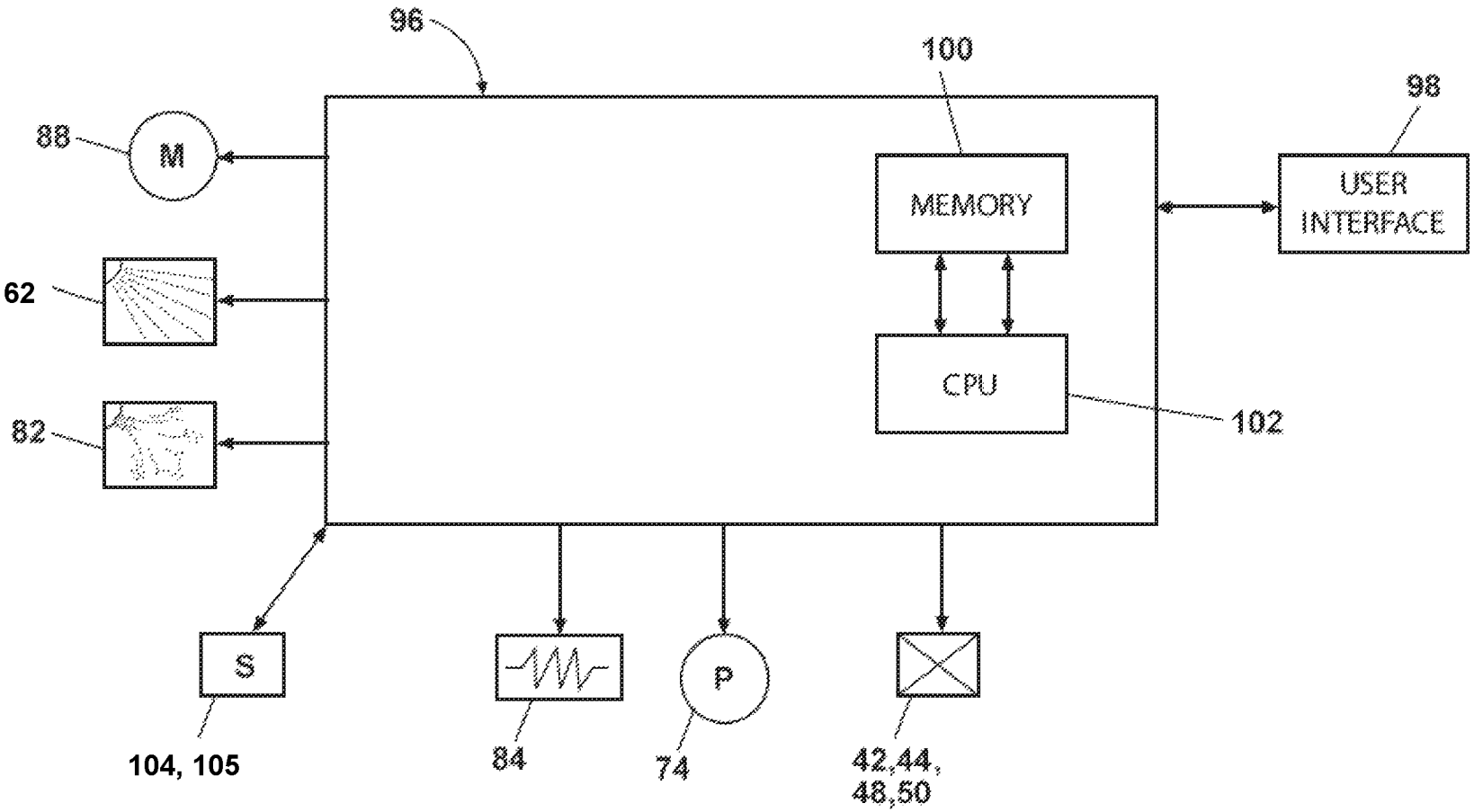
FIG. 2 is a schematic of an example control system for the example laundry treating appliance of FIG. 1.

As illustrated in FIG. 2, the controller 96 may be provided with a memory 100 and a central processing unit (CPU) or processor 102. The processor 102 can be implemented by, for example, one or more Atmel®, Intel®, AMD®, and/or ARM® microprocessors. Of course, other processors from other processor families and/or manufacturers are also appropriate. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may also be used to store the various operating parameters for the one or more cycles of operation, including factory default values for the operating parameters and any adjustments to them by the control system or by user input.

The memory 100 may include volatile memory such as synchronous dynamic random access memory (SDRAM), a dynamic random access memory (DRAM), RAMBUS® dynamic random access memory (RDRAM) and/or any other type of random access memory (RAM) device(s); and/or non-volatile memory such as flash memory(-ies), or flash memory device(s).

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82, and the sump heater 84 to control the operation of these and other components to implement one or more of the cycles of operation.

The controller 96 is coupled with one or more sensors (two of which are designated at reference numerals 104 and 105) provided in one or more of the systems of the washing machine 10 to receive input from the sensors 104, 105 (i.e., outputs of the sensors 104, 105). An example sensor 104 is an analog pressure sensor associated with the sump 70, outputs of which are representative of the amount or level of liquid in the sump 70. The example sensor 105 may be associated with a cup 63A of the dispenser 62, a siphon 63B in the cup 63A, or an outlet of the dispenser 62. The sensors 104, 105 and their usage by the controller 92 to detect treating chemistry(-ies) will be discussed below in more detail. Additional sensors that are known in the art and not shown for simplicity may be implemented and/or included. Non-limiting examples of additional sensors that may be communicably coupled with the controller 96 include: a treating chamber temperature sensor, a moisture sensor, a weight sensor, a chemical sensor, a position sensor, a load position sensor, a ball balancing ring ball position sensor, a motor temperature sensor, a motor torque sensor. etc.

The amount or level of liquid in the dispenser cup 63A has to reach a predetermined value or activation amount before the siphon 63B in the cup 63A will activate such that the liquid begins flowing upward through the siphon 63B, thus being transferred from the cup 63A into the treating chamber 18. Normally, a user will place at least an expected minimum amount of treating chemistry into the cup 63A. Additionally, normally the siphon 63B and the cup 63B are designed so that the maximum amount of treating chemistry a user is expected to place in the cup 63A will not activate the siphon 63B. Accordingly, during a cycle of operation, the washing machine 10 has to add or introduce enough additional liquid (e.g., water) into the cup 63A so the activation amount is reached and the siphon 63B is activated.

Therefore, some examples disclosed herein detect the presence of treating chemistry in the cup 63A by introducing into the cup 63A an amount of a liquid (e.g., water) corresponding to the difference between the activation amount and the expected minimum. If adding that amount of water causes the siphon 63B to activate, then it can be presumed that treating chemistry was present in the cup 63A. If the siphon 63B does not activate, then it can be presumed that treating chemistry was not present in the cup 63A.

In other examples, the additional water is added in a step-wise or incremental fashion. After each amount of water is added, activation of the siphon 63B is monitored. The amount of water needed to activate the siphon 63B is representative of the amount of treating chemistry in the cup 63A. The more water needed to activate the siphon 63B indicates that a smaller amount of treating chemistry was present in the cup 63A. Accordingly, cycle of operation adjustments based on the amount of treating chemistry can also be made. For example, if a large amount of detergent is present but a small load size is detected, adjustments to reduce sudsing or increase rinse activity may be made.

To detect activation of the siphon 63A, the example methods and apparatus disclosed herein use one or more of the sensors 104, 105 to detect the flow of liquid from the dispenser 62 into the treating chamber 18 and/or the sump 70. In some examples, the sensor 104 is used to determine the amount of, or a change in the amount of liquid in the sump 70. As treating chemistry is being dispensed, some water will flow into the cup(s) 63A, and a usually larger amount of water will flow directly into the outlet 64 and into the treating chamber 18. Accordingly, the output of the sensor 104 will reflect the initial in rush of water that flowed directly into the outlet 64 subsequently followed by a slower and smaller flow of liquid via the siphon 63B, assuming the siphon 63B activated. Thus, in some examples, activation of the siphon 63B is detected by detecting the initial in rush followed by a steady increase in the amount or level of liquid in the sump 70. To detect this steady increase, the output signal of the sensor 104 may be sampled and analyzed for an increasing trend in the amount or level of liquid in the sump 70. For example, the slope of the curve represented by the samples can be compared to a threshold, a difference between samples can be compared to a threshold, a progressive increase between each pair of samples can be detected, etc. In practice, the selection of a threshold depends on, for example, the intended flow rate of the siphon 63B, variability in the intended flow rate, expected range of fluid viscosity, accuracy of incoming water flow rate or amount, bias toward false positive versus false negative, etc. In some examples, the threshold is determined empirically.

In other examples, a sensor 105 associated with the cup 63A is used. Example sensors 105 that may be used with the cup 63A include, but are not limited to, a Hall Effect sensor, a load cell, an accelerometer, a float, and a capacitive sensor. Such sensors may be used to directly detect or measure the amount or level of liquid or treating chemistry in the cup 63A. These sensors may be used to represent a continuum of amounts or levels, or may be used to represent a particular discrete set of amounts or levels (e.g., empty, ¼ full, ½ full, ¾ full, and full). Furthermore, these sensors may be used to monitor the filling of the cup 63A, and the subsequent emptying of the cup 63A by the siphon 63B.

In additional examples, a sensor 105 associated with the siphon 63B is used. An example sensor 105 is a capacitive sensor in the siphon 63B. When the siphon 63B is activated so that liquid flows upward through the siphon 63B, the capacitive sensor 105 would activate, thus providing an indication of siphon activation.

In still further examples, the sensor 105 associated with the dispenser outlet 64 or a base of the dispenser 62 is used. Example sensors 105 include, but are not limited to, a turbidity sensor and a piezoelectric sensor. In addition to detecting siphon activation, a piezoelectric sensor could additionally be used to distinguish liquid types due to the differing drag effects on the piezoelectric sensor by different liquid types or viscosities.

It should be understood that conventional filtering or other processing may be applied to the output signals of the sensors 104, 105 to reduce, for example, noise.

When water has been added to the cup 63A, but siphon activation has not been detected, it is preferable that enough additional water be added to the cup 63A to activate the siphon 63B and empty the cup 63A. Thus, when the user next accesses the dispenser 62 the cup 63A will be empty.

Figure 3:
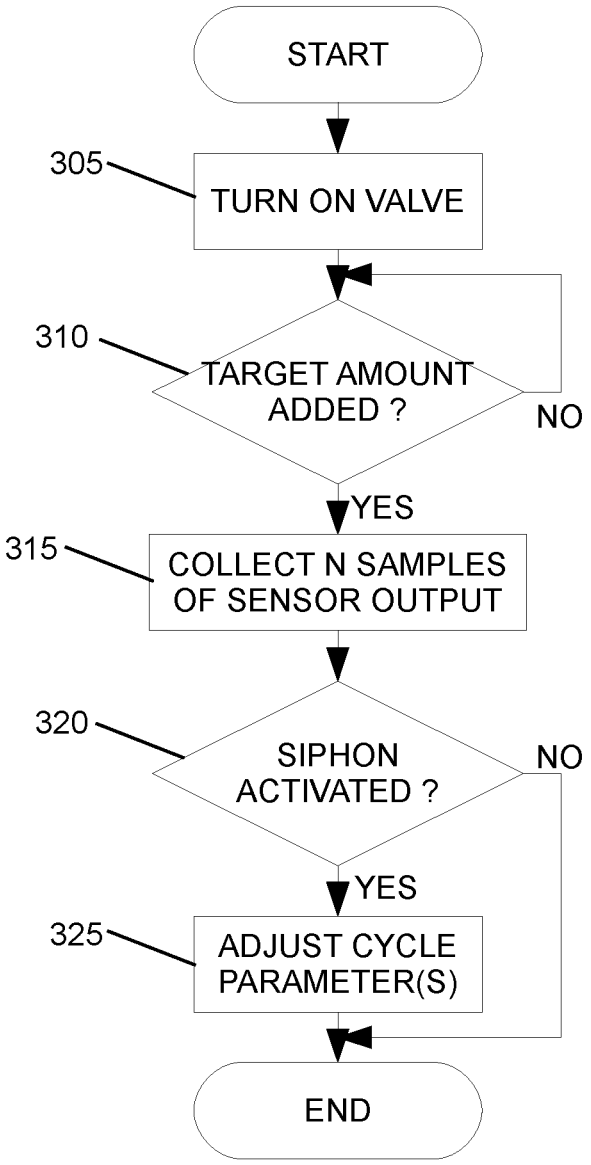
FIGS. 3 and 4 are flowcharts illustrating example methods that may be performed by the example laundry treating application of FIGS. 1 and 2 to detect treating chemistries.
Figure 4:
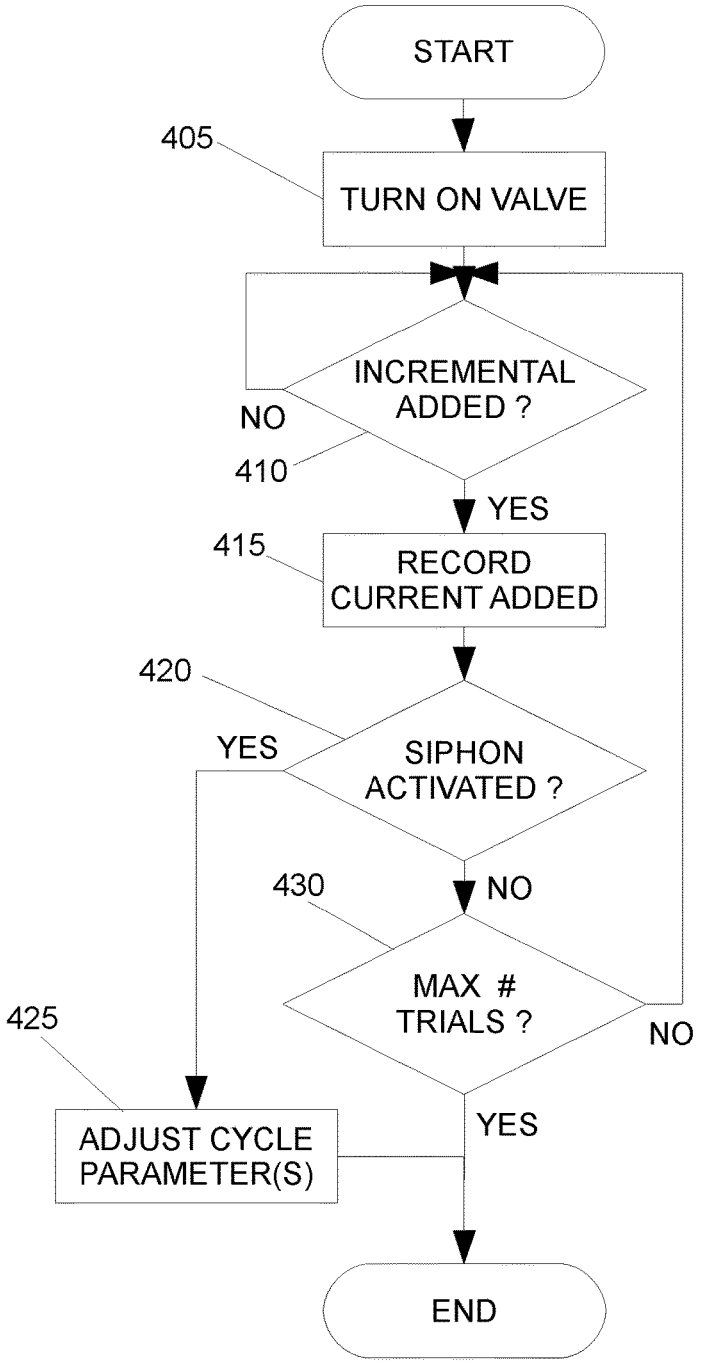

FIGS. 3 and 4 are example methods that may be performed or carried out by, for example, the controller 96 to detect treating chemistry(-ies). The example method of FIG. 3 begins with the controller 96 turning on an inlet water valve to add water to the cup 63A (block 305). Using the sensor 104, when a target amount of water has been added, e.g., an amount of water corresponding to the activation level minus the expected minimum amount of treating chemistry (block 310), the controller 96 collects N samples of the sensor output (block 315). The controller 96 preferably collects the N samples after the initial in rush of water has passed. An example value of N is 3.

As discussed above, the controller 96 processes the N samples to determine whether the siphon 63B activated (block 320). If the siphon 63B activated (block 320), the controller 96 adjusts one or more parameters of a cycle of operation (block 325) (e.g., activates bleach phase if bleach is detected), and control exits from the example method of FIG. 3. If the siphon 63B does not activate (block 320), control exits from the example method of FIG. 3. In some examples, differing cycle parameters are adjusted for both outcomes of block 320.

When the sensor 105 is used, it may not be necessary to collect N samples at block 315, as activation of the siphon 63B is more directly detectable.

The example method of FIG. 4 detects the presence and amount of treating chemistry in the cup 63A. Accordingly, water is incrementally added to the cup 63A. The example method of FIG. 4 begins with the controller 96 turning on an inlet water valve to add water to the cup 63A (block 405). When a target incremental amount of water has been added (block 410), the controller 96 records the current amount of added water (block 415). The controller 96 determines whether the siphon 63B has been activated by, for example, collecting and processing N samples as described above in connection with FIG. 3, or taking a measurement with the sensor 105 (block 420).

If the siphon 63B activated (block 420), the controller 96 adjusts one or more parameters of a cycle of operation (block 425), and control exits from the example method of FIG. 4. If the siphon 63B does not activate (block 420), the controller 96 determines whether the maximum number of trials have been carried out (block 430). If the maximum number of trials have not been performed (block 430), control returns to block 410 to add more water. If the maximum number of steps have been carried out (block 430), control exits from the example method of FIG. 3. In some examples, differing cycle parameters are adjusted as the example method of FIG. 4 exits from block 430.

The example methods shown in FIGS. 3 and 4 may, for example, be implemented as machine-readable instructions carried out by one or more processors to implement the example controller 96 of FIGS. 1 and 2. A processor, a controller and/or any other suitable processing device may be used, configured and/or programmed to execute and/or carry out the example methods of FIGS. 3 and 4. For example, the example methods of FIGS. 3 and 4 may be embodied in program code and/or machine-readable instructions stored on a tangible and/or non-transitory computer-readable medium accessible by a processor, a computer and/or other machine having a processor. Machine-readable instructions comprise, for example, instructions that cause a processor, a computer and/or a machine having a processor to perform one or more particular processes. Alternatively, some or all of the example methods of FIGS. 3 and 4 may be implemented using any combination(s) of fuses, application-specific integrated circuit(s) (ASIC(s)), programmable logic device(s) (PLD(s)), field-programmable logic device(s) (FPLD(s)), field programmable gate array(s) (FPGA(s)), discrete logic, hardware, firmware, etc. Also, some or all of the example methods of FIGS. 3 and 4 may be implemented using any combination of any of the foregoing techniques, for example, any combination of firmware, software, discrete logic and/or hardware. Further, many other methods of implementing the example methods of FIGS. 3 and 4 may be employed. For example, the order of execution may be changed, and/or one or more of the blocks and/or interactions described may be changed, eliminated, sub-divided, or combined. Additionally, any or the entire example methods of FIGS. 3 and 4 may be carried out sequentially and/or carried out in parallel by, for example, separate processing threads, processors, devices, discrete logic, circuits, etc.

As used herein, the term "computer-readable medium" is expressly defined to include any type of computer-readable medium and to expressly exclude propagating signals. Example computer-readable medium include, but are not limited to, a volatile and/or non-volatile memory, a volatile and/or non-volatile memory device, a compact disc (CD), a digital versatile disc (DVD), a read-only memory (ROM), a random-access memory (RAM), a programmable ROM (PROM), an electronically-programmable ROM (EPROM), an electronically-erasable PROM (EEPROM), an optical storage disk, an optical storage device, a magnetic storage disk, a magnetic storage device, a cache, and/or any other storage media in which information is stored for any duration (e.g., for extended time periods, permanently, brief instances, for temporarily buffering, and/or for caching of the information) and that can be accessed by a processor, a computer and/or other machine having a processor.

Any terms such as, but not limited to, approximately, substantially, generally, etc. used herein to indicate that a precise value, structure, feature, etc. is not required, need not be specified, etc. For example, a first value being approximately a second value means that from a practical implementation perspective they can be considered as if equal for a practical implementation. Moreover, it should be recognize that, for example, output signals of sensors will be sampled and, thus, only discrete quantized samples of the signals are available. Such samples have values that generally represent or approximate the original signal, but differ due to the effect of quantization.

In this specification and the appended claims, the singular forms "a," "an" and "the" do not exclude the plural reference unless the context clearly dictates otherwise. Further, conjunctions such as "and," "or," and "and/or" used in this specification and the appended claims are inclusive unless the context clearly dictates otherwise. For example, "A and/or B" includes A alone, B alone, and A with B; "A or B" includes A with B, and "A and B" includes A alone, and B alone. Further still, connecting lines, or connectors shown in the various figures presented are intended to represent example functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A method of operating a laundry treating appliance having a tub, a rotatable drum disposed in the tub and defining a treating chamber in which laundry is received for treatment according to a cycle of operation, and a treating chemistry dispenser to dispense a treating chemistry into at least one of the tub or the drum, the method comprising:

adding a predetermined amount of liquid to a cup of the dispenser sufficient to activate a siphon in the cup if a predetermined amount of the treating chemistry is present in the cup;

determining whether the siphon activates in response to the predetermined amount of liquid based on an output of a sensor; and modifying the cycle of operation based on whether the siphon activates in response to the predetermined amount of liquid, wherein a controller is configured to execute the adding, determining, and modifying steps.

2. A method as defined in claim 1, further comprising:

adding an additional predetermined amount of liquid to the cup sufficient to activate the siphon if another predetermined amount of treating chemistry is present in the cup;

determining whether the siphon activates in response to the additional predetermined amount of liquid based on the output of the sensor; and modifying the cycle of operation based on whether the siphon activates in response to the additional predetermined amount of liquid.

3. A method as defined in claim 2, wherein the modification of the cycle of operation in response to the additional predetermined amount of liquid differs from the modification of the cycle of operation in response to the predetermined amount of liquid.

4. A method as defined in claim 1, wherein determining whether the siphon activates comprises determining a change in an analog pressure sensor output associated with a sump of the laundry treating appliance.

5. A method as defined in claim 4, wherein determining whether the siphon activates further comprises:

determining an initial in rush of liquid into the sump based on the analog pressure sensor output;

collecting samples of a signal output by the analog pressure sensor subsequent to the in rush; and detecting a progressive increase of liquid in the sump base on the collected samples.

6. A method as defined in claim 1, wherein determining whether the siphon activates comprises determining a change in an output of the sensor, and wherein the sensor is associated with the cup.

7. A method as defined in claim 1, wherein determining whether the siphon activates comprises determining a change in an output of the sensor, and wherein the sensor is associated with the siphon.

8. A method as defined in claim 1, wherein determining whether the siphon activates comprises determining a change in an output of the sensor, and wherein the sensor is associated with an outlet of the dispenser.

9. A method as defined in claim 8, wherein the output of the sensor comprises an output of a piezoelectric sensor, and further comprising determining a type of treating chemistry based on the output of the piezoelectric sensor.

* * * * *